US005253860A

United States Patent [19]

Hirose et al.

[11] Patent Number: 5,253,860

[45] Date of Patent: Oct. 19, 1993

[54] FINISHER FOR AN IMAGE FORMING APPARATUS

[75] Inventors: Akira Hirose, Tokyo; Takashi Fujii, Ohmiya; Fumitaka Hyodou, Nukata, all of Japan

[73] Assignee: Ricoh Company, Ltd., Tokyo, Japan

[21] Appl. No.: 925,981

[22] Filed: Aug. 5, 1992

[30] Foreign Application Priority Data

Aug. 6, 1991 [JP] Japan ..... 3-219281
Aug. 29, 1991 [JP] Japan ..... 3-242393

[51] Int. Cl.[5] ..... B65H 29/22

[52] U.S. Cl. ..... 271/176; 271/221; 271/270; 271/293; 271/294; 271/314

[58] Field of Search ..... 271/176, 202, 270, 221, 271/222, 314, 293, 294

[56] References Cited

U.S. PATENT DOCUMENTS 4,634,263 1/1987 Miwa ..... 271/270 X
5,083,761 1/1992 Johdai ..... 271/221 X
5,086,320 2/1992 Koike ..... 271/270 X
5,090,673 2/1992 Kitahara ..... 271/221 X

*Primary Examiner*—Richard A. Schacher
*Attorney, Agent, or Firm*—Cooper & Dunham

[57] ABSTRACT

A finisher connectable to an image forming apparatus for surely discharging sheets to bin trays thereof without regard to the sheet size while preventing the sheets from dropping from the bin rays or from being inaccurately positioned on the bin trays. The finisher has a discharge roller for sequentially discharging sheets driven out of the image forming apparatus to the bin trays. The rotation speed of the discharge roller is controlled on the basis of size information representative of the size of sheets to be transferred from the image forming apparatus to the finisher.

14 Claims, 12 Drawing Sheets

FINISHER FOR AN IMAGE FORMING APPARATUS

BACKGROUND OF THE INVENTION

The present invention relates to a copier or similar image forming apparatus and, more particularly, to a finisher connetable to an image forming apparatus for sorting and, if necessary, binding sheets driven out of the apparatus and distributed to a plurality of bins thereof which are arranged one above another.

A finisher for the above application is often implemented as a sheet distribution type finisher which receives a desired number of sets of copy sheets of the same document sheets from an image forming apparatus and sequentially distributes the copy sheets to the same number of bin trays thereof as the number of sets of copy sheets. It is a common practice with this type of finisher to fix the bin trays in place and shift a discharge position for discharging sheets to the bin trays or to fix the discharge position and sequentially move the bin trays relative to the discharge position. For example, Japanese Patent Laid-Open Publication No. 4855/1982 discloses a sorting device which increases the clearance between the bin tray to receive a sheet and the immediately overlying bin tray by use of a Geneva wheel so as to facilitate the receipt of a sheet. Japanese Patent Laid-Open Publication 78769/1981 proposes an improved sorting device which increases the above-mentioned clearance by use of a helical cam. Further, Japanese Patent Laid-Open Publication No. 110075/1990 teaches a sorting device having bin trays movable up and down and a cam for causing one of the bin trays for receiving a sheet to move in a direction parallel to the stacking surface thereof. This is successful in forming a sheet inlet without increasing the clearance between nearby bin trays.

The conventional finishers each has a discharge roller located at a discharge position adjacent to the bin trays for transporting sheets driven out of an image forming apparatus to the bin trays. Specifically, the discharge roller is spaced apart by a predetermined distance from a trailing edge positioning fence (simply referred to as a fence hereinafter) which is provided on each bin, requiring a sheet to fly to the bin tray over the fence of the bin tray. To meet this requirement, the discharge roller is rotated at a high speed to discharge a sheet at an initial speed high enough for the sheet to fly the predetermined distance to the bin tray. This brings about a problem that when the distance which a sheet flies is short, the rear edge of the sheet fails to go over the fence of the bin tray while, if the distance is excessive, the sheet flies beyond a sheet stack existing on the bin tray and cannot be neatly arranged together with the sheet stack. Especially, when the sheet is soft or warped, it is likely that the leading edge of the sheet being driven out by the discharge roller toward the bin tray is inclined in the right-and-left direction or is offset in the same direction when dropped onto the bin tray. Another problem is that a sheet dropped onto the bin tray slides down on the existing sheet stack while flying in the right-and-left direction due to the friction between the sheet and the sheet stack, static electricity, air stream, etc. Such a sheet abuts against the fence of the bin tray, further springs up, an then drop to a different position. In this manner, the sheet brought to a stop in abutment against the fence is noticeably irregular in the right-and-left position. This type of finisher, therefore, needs a positioning device for correcting the position of sheet on the bin tray. A positioning device is also essential to to finisher having a binding function or a punching function in order to provide a finished sheet stack with attractive appearance.

In an intended direction of sheet transport, the finisher usually positions a sheet on the bin tray by causing the sheet sliding down along the sacking surface of the bin tray due to gravity to abut against the fence. In a direction perpendicular to the direction of sheet transport, the finisher positions the sheet by a sheet positioning device having a pressing member which is movable from a standby position in the above direction for urging the sheet against a reference wall by pressing one side thereof. Sheets of various sizes are distributed to the bin trays of the finisher, as needed. A control device is incorporated in the finisher for causing the sheet positioning device to perform a positioning action matching the sheet size. Specifically, the controller controls the distance which the pressing member moves from the standby position in response to size information sent from a sensor located on a transport path or sent from the image forming apparatus. As a result, the pressing member slightly presses one side of the sheet, retracts to and stops at the position corresponding to the side of the sheet, and then fully returns to the standby position. The pressing member may be provided on each of the bin trays so as to slide on the stacking surface of the bin tray. Alternatively, the pressing member may be constituted by a single elongate member extending through all the bin trays for positioning sheets on the bin trays at the same time.

As stated above, to position a sheet on the bin tray, the pressing member of the positioning device is driven by a motor to move a distance matching the sheet size, thereby pressing one side of the sheet. When the sheet has a size smaller than the minimum size which can be dealt with by the positioning device, the binding function or the punching function is inhibited and only the sorting function is effected. However, when the size of the sheet is far smaller than the minimum allowable size, the sheet brought to a stop in abutment against the fence is apt to drop to either side of the existing sheet stack and practically fail even to overlap the sheet stack. Then, it is likely that the order of the sheet stacks are different from expected one when they are taken out of the bin tray.

SUMMARY OF THE INVENTION

It is therefore an object of the present invention to provide a finisher for an image forming apparatus for surely discharging sheets to bin trays without regard to the sheet size while preventing the sheets from dropping from the bin rays or from being inaccurately positioned on the bin trays.

It is another object of the present invention to provide a finisher for an image forming apparatus which prevents the order of sheet stacks on bin trays from being disturbed even when sheets of a size smaller than the minimum allowable size are discharged onto the bin trays.

In accordance with the present invention, a finisher operatively connectable to a sheet discharging device for finishing sheets discharged from the device and distributed to a plurality of bin trays which are arranged one above another in the finisher comprises a discharge roller for sequentially discharging the sheets driven out of the sheet discharging device to the bin trays, a drive motor for driving the discharge roller, and a controller for controlling the rotation speed of the drive motor in response to size information representative of the size of sheets to be sequentially discharged to the bin trays.

Also, in accordance with the present invention, a finisher operatively connectable to a sheet discharging device for finishing sheets driven out of the device comprises a plurality of bin trays each having a stacking surface which is inclined in an intended direction of sheet transport for receiving sheets driven out of the sheet discharging device, a discharge roller for sequentially discharging the sheets to be plurality of bin trays, a positioning device comprising a pressing member for positioning the sheets stacked on the plurality of bin trays by pressing one side of the sheets until the sheets abut against a reference surface at the other side, and a controller for controlling the positioning operation of the positioning device on the basis of the size of the sheets such that when the sheet to be received in the bins is of the kind which cannot be positioned by the positioning device, the pressing member is moved, before the discharge roller discharges the sheet, from a standby position to a regulating position which is adjacent to and spaced apart from the reference surface by a predetermined distance and stopped at the regulating position.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

To better understand the present invention, a brief reference will be made to conventional finishers.

Figure 1:
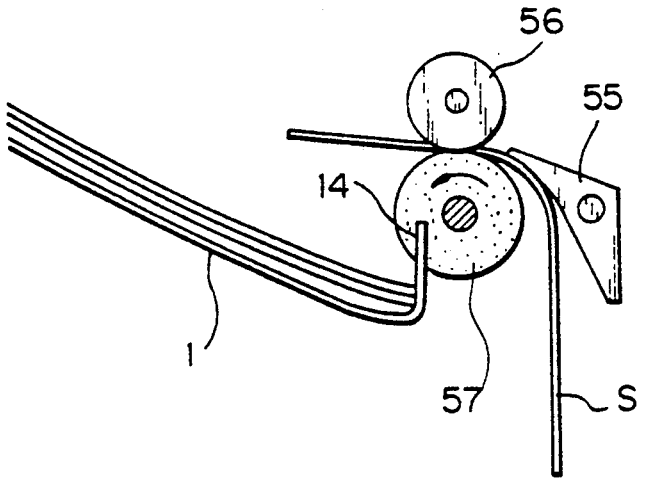
Fig. 1 PRIOR ART
FIG. 1 is a fragmentary section of a conventional finisher having fixed bin trays.

FIG. 1 shows a conventional finisher having fixed bin trays 1 (only one is shown) which are arranged one above another. A discharge roller 57, a roller 56 driven by the discharge roller 57, and a guide pawl 55 are associated with each of the bin trays 1 and located at a discharge position. As a sheet S reaches the discharge position where designated one of the bin trays 1 is located by way of an upwardly extending path, the guide pawl 55 is rotated to steer it toward the bin tray 1. The discharge roller 57 and roller 56 nip the sheet S and drive it onto the bin tray 1. Then, the guide pawl 55 is again rotated to the original or standby position, unblocking a path extending upward from it. Before the next sheet S arrives at the finisher, the guide pawl 55 located at the discharge position of another bin tray 1, usually a bin tray immediately above or immediately below the above-mentioned one, is rotated in the same manner as the previous guide pawl 55. Since the bin tray 1 and discharge roller 57 are fixed in place, the roller 57 partly protrudes into the bin tray 1 beyond a trailing edge positioning fence 14 provided on the bin tray 1 so as to insure the discharge of the sheet S onto the bin ray 1. Let the trailing edge positioning fence 14 be simply referred to as a fence hereinafter. Specifically, even when the sheet S is driven by the discharge roller 57 while partly adhering to the roller 57, it is in due course separated from the roller 57 and let fall onto the bin tray 1. Then, the trailing edge of the sheet S is urged downward by the discharge roller 57 until it abuts against the fence 14.

Figure 2:
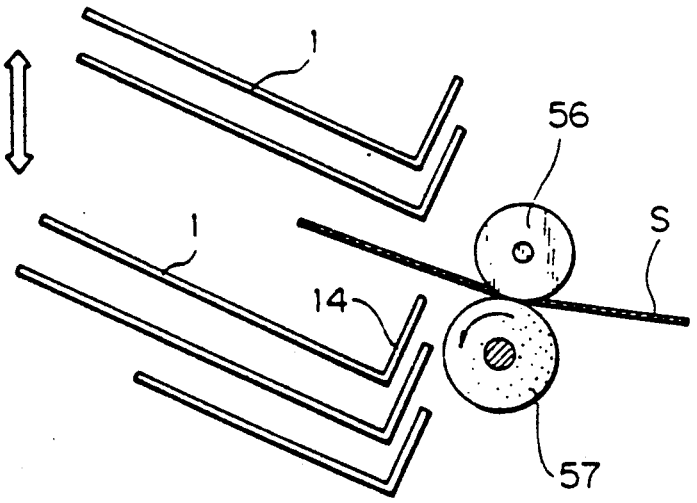
Fig. 2 PRIOR ART
FIG. 2 is a fragmentary section of another conventional finisher having movable bin trays.
Figure 3:
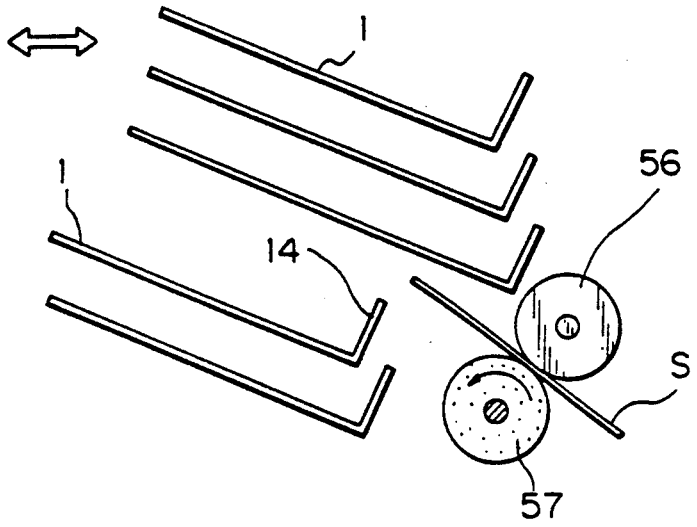
Fig. 3 PRIOR ART
FIG. 3 is a view similar to FIG. 2, showing another conventional finisher having movable bin trays.

FIGS. 2 and 3 each shows another conventional finisher in which the bin trays 1 are movable. Specifically, FIG. 2 shows a finisher of the type causing the bin trays 1 to move in the vertical direction while FIG. 3 shows a finisher of the type causing them to move in the horizontal direction. In any case, the discharge roller 57 cannot be disposed in the space in which the bin trays 1 are movable. More specifically, in the event of sorting or binding sheets S, the bin trays 1 have to be sequentially moved up or down, and therefore the roller 57 fixed in place in the vicinity of the bin trays 1 should not protrude into any of the bin trays 1. As a result, a certain clearance is required between the discharge roller 57 and the fence 14 of each bin tray 1. The sheet S, therefore, has to be received in the bin tray 1 over the fence 14. In the light of this, it is a common practice with this type of finisher to rotate the discharge roller 57 at a high speed and thereby cause the sheet S to fly toward the bin tray 1 at a high speed over a predetermined distance. Should the flight distance be short, the trailing edge of the sheet S would fail to clear the fence 14, resulting in defective discharge. Should the flight distance be excessive, the sheet S would fly beyond a sheet stack existing on the bin tray 1 and be brought out of register with the existing sheet stack. This type of finisher, therefore, has to be provided with a device for positioning the sheets S.

A preferred embodiment of the finisher in accordance with the present invention will be described hereinafter. Briefly, the finisher of the invention is usually operatively connected to a copier or similar image forming apparatus and capable of stacking, sorting and even binding a plurality of sets of sheets driven out of the apparatus continuously.

Figure 4:
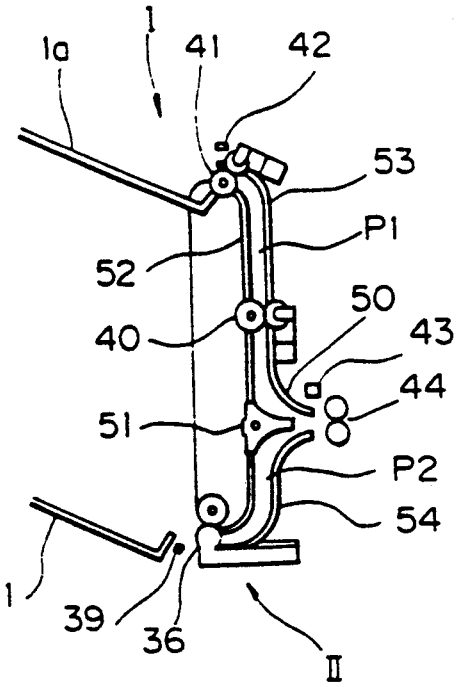
FIG. 4 is a section showing the general arrangement of a finisher embodying the present invention adjoining transport paths.
Figure 5:
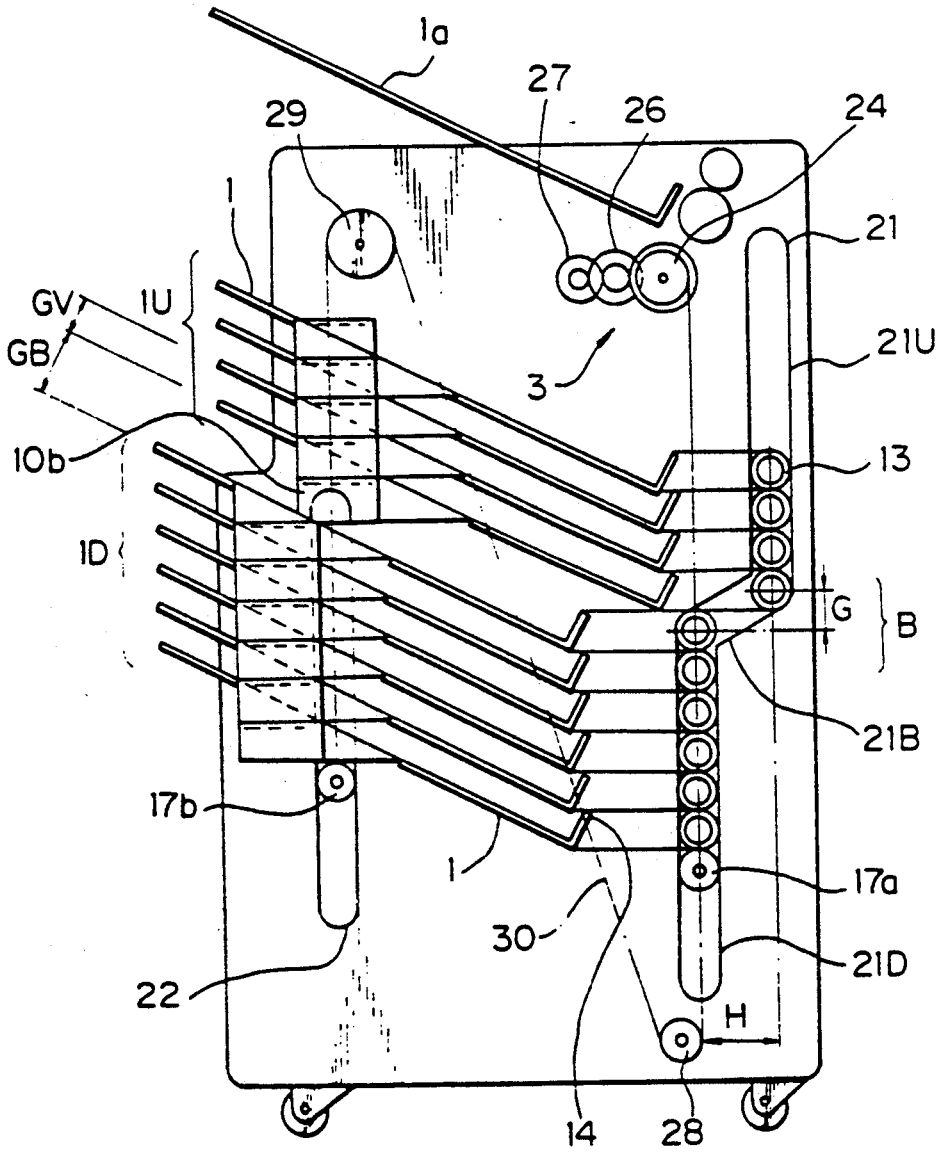
FIG. 5 is a section demonstrating a camming operation particular to the embodiment.

Specifically, as shown in FIG. 4, the finisher of the invention is generally made up of a stacking section 11 for sequentially stacking sheets S, not shown, driven out of the image forming apparatus, and a sorting and binding section II for sorting and binding the sheets S. The sheets S are selectively transported along a path P1 terminating at the stacking section I or a path P2 terminating at the sorting and binding section II. As shown in FIGS. 4–8, the finisher has a stack tray 1*a* for stacking the sheets S discharged to the stacking section I, bin trays 1 each being inclined toward the paper inlet side and receiving the sheets S coming in from the right-hand side in each figure, and slide cams 10*a* and 10*b* associated with each bin tray 1. The slide cams 10*a* and 10*b* are respectively provided on the side edges of each bin tray 1 on the paper inlet side and the side edges of the same on the other side. The upper and lower surfaces of each slide cam 10*a* or 10*b* generally extends in the horizontal direction. As shown in FIG. 5, the bin trays 1 are arranged one above another. A vertical shift device which will be described moves the bin trays 1 up and down. While the bin trays 1 are in upward or downward movement, a horizontal slide mechanism including cam tracks, as will be described later, moves the bin trays 1 a predetermined distance in the horizontal direction at a cam section B. As a result, the bin trays 1 are divided into an upper group 1U and a lower group 1D.

Referring again to FIG. 4, a discharge roller pair 44 is mounted on the body of the image forming apparatus for discharging the sheets S from the apparatus. A selector in the form of a pawl 51 selects either of the paths P1 and P2 matching a desired finishing mode. Guide plates 52 and 53 and a guide plate 54 define the paths P1 and P2, respectively. A lower discharge roller 36 and an upper discharge roller 41 discharge the sheets S to the stacking section I and the sorting and binding section II, respectively. A transport roller 40 is located in close proximity to the path P1 for transporting the sheets S. A lower discharge sensor 36 and an upper discharge sensor 42 are disposed in the finisher while a discharge sensor 43 is disposed in the apparatus body. A sheet inlet 50 is formed in the finisher. A discharge motor 37, FIG. 6, drives the lower discharge roller 36 which in turn rotates the upper discharge roller 41 and transport roller 40 via a gearing, not shown.

Figure 6:
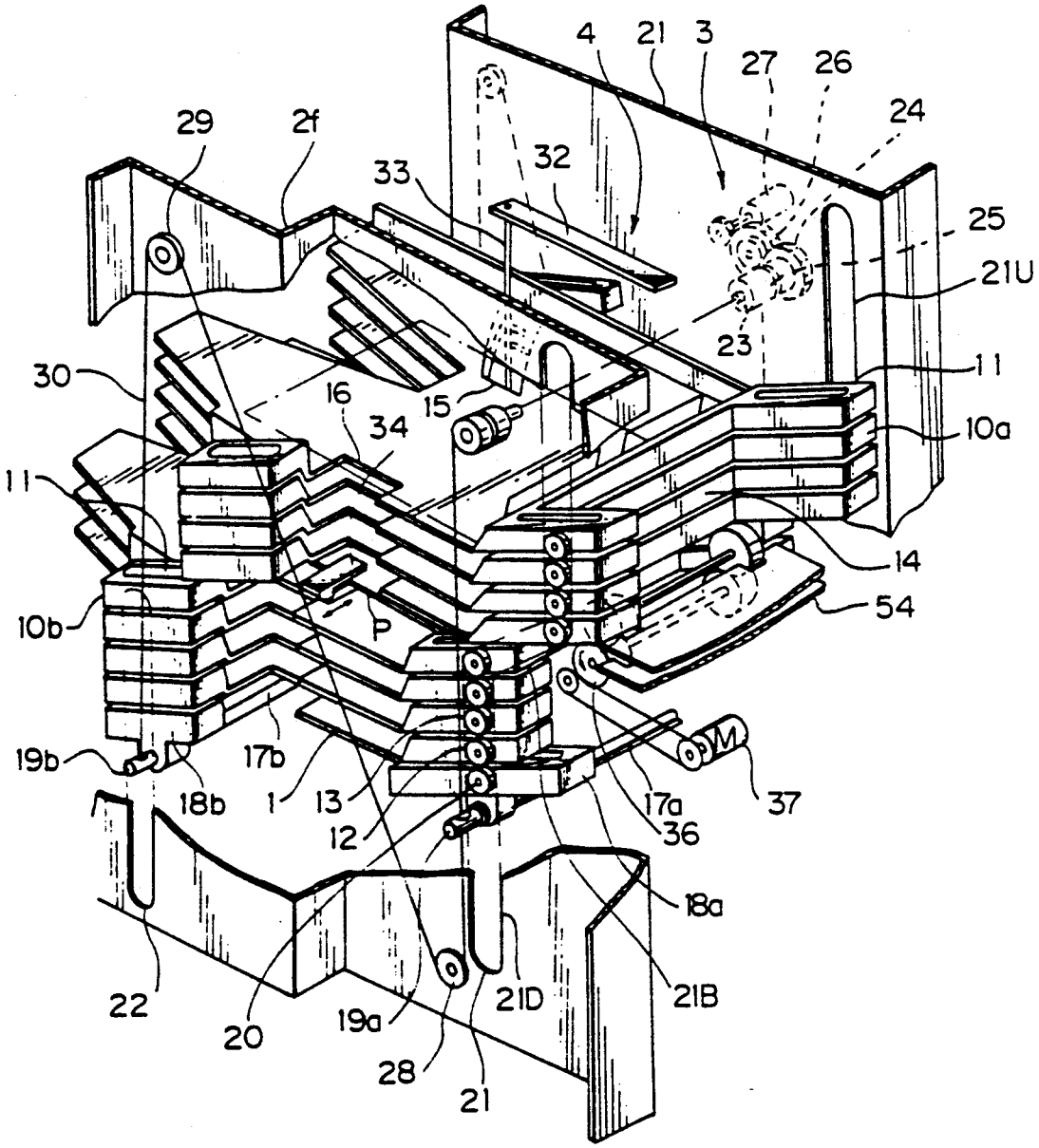
FIG. 6 is a perspective view showing the overall arrangement of the embodiment.
Figure 7:
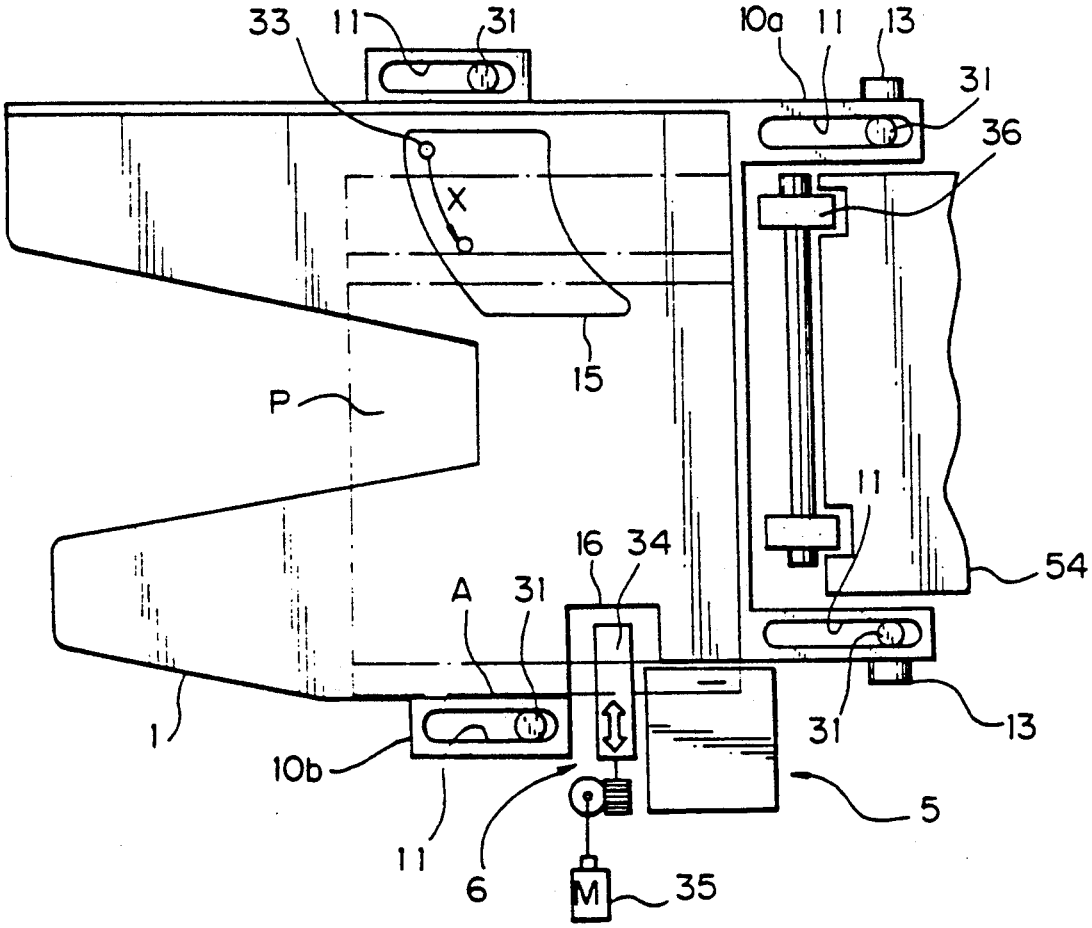
FIG. 7 is a plan view of a bin tray included in the embodiment together with parts and elements associated therewith.

As shown in FIG. 6, a positioning device 4 is located in close proximity to the rear ends of the bin trays 1. As shown in FIG. 7, a binding device 5 and a moving unit 6 are located to face each other in the vicinity of the front end of the lowermost bin tray 1 belonging to the upper group 1U. The binding device 5 binds the sheet stack P existing on the lowermost bin tray 1 of the upper group 1U by driving a staple into one end of the stack P. The moving unit 6 chucks the sheet stack P by a chuck mechanism, pulls it out to the binding position of the binding device 5, and then forces it back to the original position.

As shown in FIGS. 6 and 7, a roller groove 11 is formed in the upper and lower surfaces of each of the slide cams 10*a* and 10*b* to extend in the right-and-left direction as viewed in the figures and provided with a semicylindrical cross-section. A trunnion 13 is rollably coupled over a pin 12 studded on each side edge of the slide cam 10*a*. A bent fence 14 is provided on the paper inlet side of the bin tray 1 for positioning the trailing edge of the sheet S. A hole 15 is formed through the bin tray 1. A jogger wire included in the paper postioning device 4, as will be described, extends throughout the holes 15 of the bin trays 1. A notch 16 is formed in each bin tray 1 for receiving a chuck 34 included in the moving unit 6. A roller in the form of a ball 31 is rollably received in each of the roller grooves 11 and held between the slide cams 10*a* and 10*b* of the upper and lower bin trays 1.

The horizontal slide mechanism which moves the bin trays 1 along the slide cams 10*a* and 10*b* by using the vertical drive exerted by the vertical shift device 3 will be described with reference to FIGS. 5 and 6. As shown, the mechanism includes a front frame 2*f* and a rear frame 2*r*. The front and rear frames 2*f* and 2*r* are formed with aligned cam tracks, or slots, 21 on the paper inlet side and formed with aligned guide slots 22 on the other side. The cam tracks 21 are each made up of an upper vertical portion 21U, a lower vertical portion 21D, and a cam portion 21B connecting the upper and lower vertical portions 21U and 21D. The cam portion 21B is smoothly inclined from the lower end of the upper vertical portion 21U to the upper end of the lower vertical portion 21D. The trunnions provided on the bin trays 1 and trunnions provided on the support member of a first bin drive bar, which will be described, are received in and moved along the cam tracks 21.

A shaft 23 is journalled to the front and rear frames 2*f* and 2*r* above the lower vertical portions 21D of the cam tracks 21 by bearings. A take-up pulley 24 is affixed to opposite ends of the shaft 23 that extend out from the frames 2*f* and 2*r*. A take-up gear 25 is mounted on the shaft 23 at the outside of the rear take-up pulley 4 and held in mesh with a speed reduction gear 26 which constitutes a gear train. A vertical drive motor 27 is mounted on the rear end of the rear frame 2*r* for driving the vertical shift device 3. The rotation of the motor 27 is transmitted to the take-up gear 25 via the gear train. A first and a second redirection pulley 28 and 29 are journalled to the outer surface of each of the frames 2*f* and 2*r* and disposed below the lower vertical portion 21D of the associated cam track 21 and above the associated guide slot 22. Wires 30 are passed over the associated take-up pulleys 24 at one end and affixed to opposite ends 19*b* of a second bin drive bar 17*b* via the redirection pulleys 28 and 29 at the other end. Further, the wires 30 are affixed to both ends 19*a* of a first bin drive bar 17*a* between the take-up pulley 24 and the first redirection pulley 28. In this configuration, the wires 30 support the bin trays 1 stacked on the first and second bin drive bars 17*a* and 17*b* and move them up and down via the bars 17*a* and 17*b*.

Figure 8:
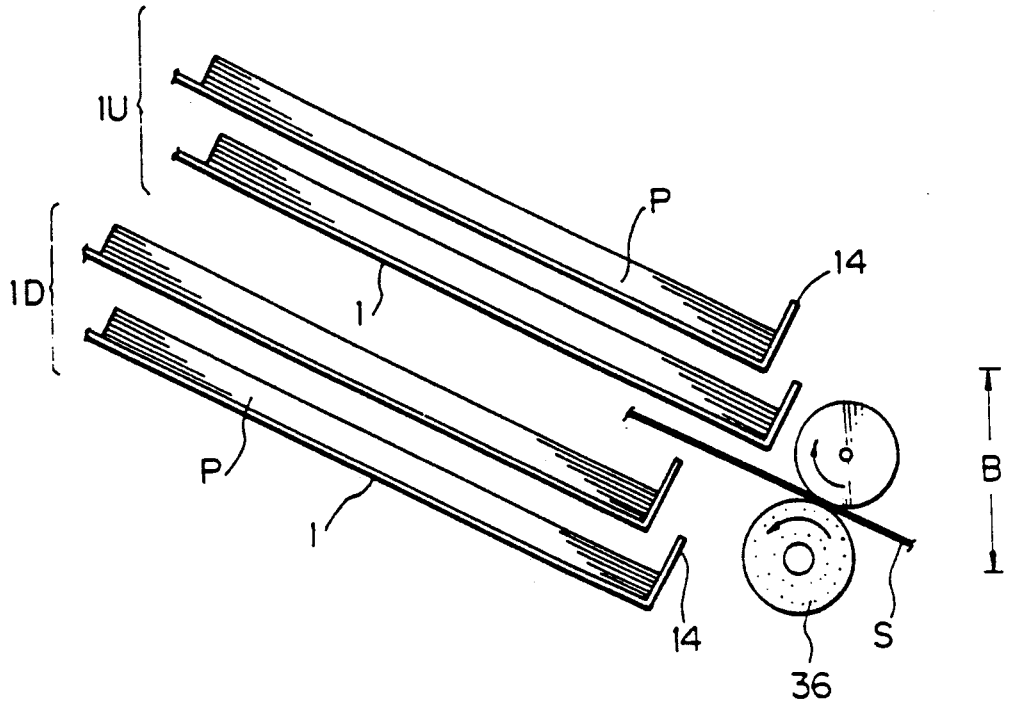
FIG. 8 is an enlarged section of a cam section included in the embodiment.

First support members 18*a* and 18*b* are affixed to both ends of the first and second bin drive bars 17*a* and 17*b* so as to sustain the bin trays 1. A roller groove 11 is also formed in the upper surface of each support member 18*a* or 18*b* and extends in the right-and-left direction as viewed in the figures. A roller 31 is received in each roller groove 31. A trunnion 13 is also movably coupled over a pin 20 studded on the outer periphery of the first support member 18*a*. The trunnion 13 of the first support member 18*a* is received in the cam track 21 together with the trunnions 13 of the bin trays 1, so that all the trunnions 13 move integrally along the vertical portions of the cam track 21. Jogger arms 32 (only one is visible) is driven by a drive mechanism, not shown, to rotate counterclockwise. A jogger wire 33 has upper and lower ends thereof affixed to the free ends of the jogger arms 32 and position the sheets S received in the bin trays by hitting against the trailing edges of the sheets S, i.e., by causing the sheets S to abut against the front end of the bin trays 1. The jogger arms 32 and jogger wire 33 constitute the paper positioning device 4 in cooperation with the above-mentioned drive mechanism. As shown in FIG. 8, the lower discharge roller 36 is located to face the sheet inlet ends of the bin trays 1 lying in the cam section B and is spaced apart from the latter by a predetermined distance. Driven by the previously mentioned motor 37, the lower discharge roller 36 drives the sheet S carrying an image thereon at a particular speed which allows the sheet S to be surely received in the bin tray 1 lying in the cam section B without regard to the size of the sheet S.

In operation, as the operator presses a mode key, not shown, provided on the operation panel, not shown, of the image forming apparatus for setting up a desired finishing mode and then presses a print start key, not shown, the image forming apparatus starts on image formation. A sheet S carrying an image thereon is driven out of the apparatus into the finisher by the discharge roller pair 44, FIG. 4, of the apparatus body. Assuming that a stack mode is selected, a solenoid, not shown, is energized to rotate the selector 51 clockwise to thereby unblock the path P1. The transport roller 44 transports the incoming sheet S toward the stacking section I along the path P1 at the same speed as the discharge roller pair 44. The discharge roller 41 discharges the sheet S onto the stack tray 1*a* at a predetermined speed which prevents the sheet S from flying beyond the sheet stack P existing on the tray 1*a*. The sheet S is abutted against and positioned by the fence 14 of the stack tray 1*a*.

Assume that a stack mode or a bind mode is selected on the operation panel of the image forming apparatus. Then, the selector or pawl 51 is rotated counterclockwise to unblock the path P2. As the discharge sensor 43 determines that a sheet S has been fully driven out of the apparatus body by the discharge roller pair 44, the apparatus body sends a control signal to the finisher. On receiving the control signal, a controller or CPU (Central Processing Unit) 60, FIG. 10, included in the finisher accelerates the rotation of the discharge motor 37 to a predetermined speed to transport the sheet S rapidly. At the same time, the CPU 60 rotates the lower discharge roller 36 at a speed high enough for the sheet S to fly toward the bin tray 1 over a particular distance matching the paper size. As the lower discharge sensor 39 determines that the trailing edge of the sheet S has moved away from the roller 36, the CPU 60 restores the roller 36 to its ordinary rotation speed.

Assume that one of the bin trays 1 to receive sheets S is selected beforehand. Then, the apparatus body sends a signal designating the particular bin tray 1 to the finisher. In response, as shown in FIG. 5, the CPU 60 rotates the vertical drive motor 27 in the forward or reverse direction a predetermined number of rotations. As a result, the bin trays 1 are moved up or down via the wire 30 until the designated bin tray 1 arrives at the cam section B. At this instant, the trunnions 13 provided on the edges of the slide cams 10*a* move along the cam tracks 21. Assume that the designated bin tray 1 belongs to the lower group 1D. The bin trays 1 supported by the first and second bin drive bars 17*a* and 17*b* and first and second support members 18*a* and 18*b* are lifted by the wires 30 over a predetermined distance. When any one of the bin trays 1 reaches the cam portions 21B of the cam tracks 21 with the trunnions 13 thereof rolling, it is prevented from moving further upward by the inclined cam portions 21B and, instead, steered obliquely upward toward the paper inlet side along the cam portions 21B. Specifically, the bin tray 1 is caused to slide toward the sheet inlet side by being supported by the rollers 31 which roll in the associated roller grooves 11. After the trunnions 13 of the bin tray 1 have reached the upper or right end of the cam portions 21B of the cam tracks 21, the bin tray 1 is guided vertically upward by the upper vertical portions 21U.

As soon as the designated bin tray 1 reaches the cam section B, the vertical drive motor 27 is deenergized. The bin tray 1 of interest is now ready to receive a sheet S. At this instant, the bin trays 1 above the cam section B have their downstream ends located upstream of the downstream ends of the bin trays 1 below the cam section B by a horizontal direction H, FIG. 5, due to the above-stated camming operation. This is advantageous in that the operator can see the upper surface of the bin tray 1 located in the cam section B, e.g., the quality of a copy sheet or the condition of the sheet stack from the downstream side of the finisher.

As stated above, the clearance between nearby bin trays 1 is increased in the cam section B only by the horizontal movement of the bin tray 1 caused by the trunnions 13 which are guided by the cam tracks 21 in association with the vertical movement of the bin trays 1. Hence, the position of the bin tray 1 does not change in the vertical direction even when it is cammed in the cam section B. Specifically, as shown in FIG. 5, the distance G between nearby trays 1 is maintained constant, and the slide cams 10, i.e., supports intervening between the bin trays 1 are not spaced apart from each other. As shown in FIG. 5, by the horizontal movement of the bin tray 1 from the lower group 1D to the upper group 1U over the distance H, the clearance GB between nearby bin trays 1 in the cam section B increases in association with the distance of horizontal movement of the bin tray 1 and the inclination of the cam portions 21B of the cam tracks 21, relative to the distance GB in the upper group 1U or the lower group 1D. The discharge roller 36 is located to face the sheet inlet end of the bin tray 1 assuming the above-mentioned position and spaced apart from the latter by a predetermined distance, as stated earlier. A sheet S is discharged to between nearby bin trays 1 which are spaced apart by the increased distance GB, and then it is abutted against and positioned by the fence 14 due to gravity. Should the inclination angle of the cam portions 21B be excessively small, it would be difficult for the trunnions 13 to shift from the lower vertical portions 21D to the upper vertical portions 21U smoothly although the distance GB between the bin trays 1 would be increased. On the other hand, should the inclination angle be excessively great, the distance GB in the cam section B would be short. In the illustrative embodiment, the lower discharge rollers 36 and lower driven rollers 56 are provided in pairs at the right-hand side and left-hand side of the transport direction. The discharge rollers 36 and driven rollers 56 are held in contact with each other by springs, not shown, exerting a predetermined biasing force. A sheet S is driven by such roller pairs and then discharged at a predetermined speed to fall on the bin tray 1.

After the trailing edge of the sheet S discharged from the lower discharge rollers 36 has been positioned, the paper positioning device 4 starts operating, as shown in FIG. 7. Specifically, the jogger arms 32 are rotated counterclockwise by a predetermined angle (arrow X). Then, the jogger wire 33 is moved in an arc from a standby position at the right-hand side with respect to the transport direction to the left or upstream side within the holes 15 of the bin trays 1, whereby the sheet S received in the bin tray 1 is positioned at one side thereof. Specifically, the paper sheet S is brought into abutment against a reference wall A provided on the bin tray 1 to be thereby positioned at the left side thereof. It is to be noted that the position where the jogger wire 33 having hit against the side of the paper sheet S and urged the sheet S against the reference wall A stops depends on the size (width) of the sheet S; the smaller the sheet size, the closer to the reference wall A the stop position is. To control the start and stop of the movement of the jogger wire 33, the CPU 60, FIG. 10, controls the rotation speed of a motor 72, FIG. 14, which drives the positioning device 4 in response to size information sent from the image forming apparatus. Assume that the size of the sheet S transferred from the image forming apparatus to the finisher is smaller than the minimum size which can be dealt with by the positioning device 4. Then, the CPU 60 inhibits the positioning device 4 from operating and, at the same time, moves the jogger wire 33 to a regulating position which is spaced from the reference wall A by a distance slightly smaller than double the width of the sheet S. This is successful in preventing the sheet S from the lower discharge roller 36 from flying to the right beyond the regulating position.

Figure 9:
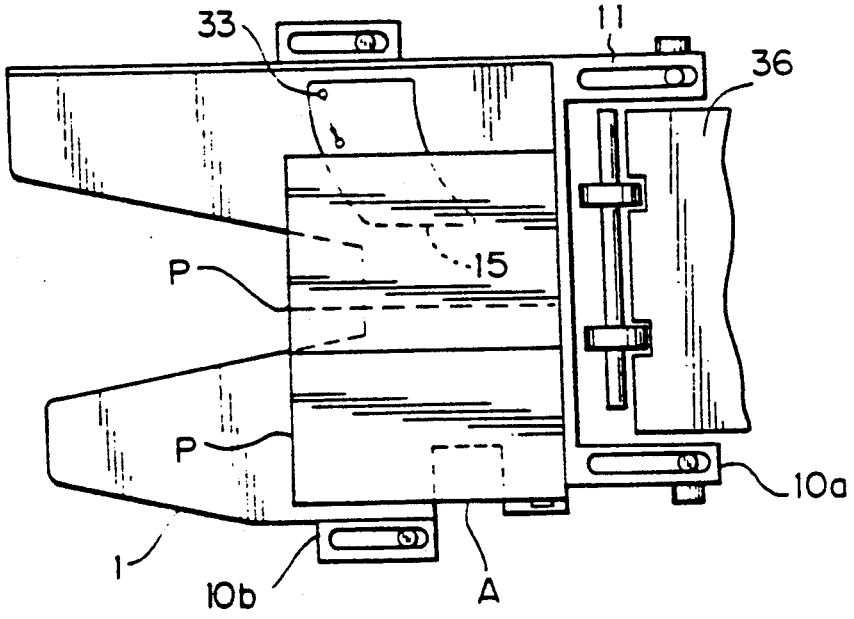
FIG. 9 is a view showing how a sheet whose size is smaller than the minimum allowable size is laid on a bin tray.

Specifically, the sheet S whose size is smaller than the minimum allowable size is discharged onto the bin tray 1 in the condition shown in FIG. 9. As shown, the sheet S discharged by the lower discharge roller 36 and sliding down toward the fence 14 is not movable beyond the jogger wire 33 held at the regulating position or the reference wall A. Therefore, the sheet S fallen onto the bin tray 1 at least partly overlaps the sheet stack existing on the bin tray 1, so that the order of the sheet stacks P is identical with the discharge order of the sheets S without fail.

Before the next sheet S is driven out from the image forming apparatus, the next bin tray 1 is moved to the cam section B. For this purpose, the CPU 60 of the finisher delivers a control signal to the vertical drive motor 27 to thereby rotate it a predetermined number of rotations. As a result, the first and second bin drive bars 17*a* and 17*b* are lifted to shift the uppermost bin tray 1 of the lower group 1D to the lowermost position of the upper group 1U, as shown in FIG. 5. The bin tray 1 which is now the lowermost bin tray of the upper group 1U is spaced apart from the immediately underlying bin tray 1 by a broader distance GB and from the immediately overlying bin tray 1 by a narrower distance GB. In this condition, when the sheet S is warped or when the existing sheet stack P has reached a predetermined amount, the sheet S is straightened by being urged against the underside of the bin tray 1 which is now the second bin tray from the bottom of the upper group 1U.

The sorting operation is completed by the above sequence of intermittent lift of the bin trays 1 by the vertical shift device 3 and the distribution of sheets S to the bin trays 1. Subsequently, when the CPU 60 of the finisher receives a bind command from the image forming apparatus, it causes the binding device 5 to bind the stacks P, as follows. To begin with, the CPU 60 rotates the vertical drive motor 27 to raise or lower the bin trays 1 until the uppermost bin tray 1 loaded with a sheet stack P reaches the lowermost position of the upper group 1U. Then, the CPU 35 drives the motor 35 to bring the chuck 34 of the moving unit 6 into the notch 16 of the bin tray 1 while causing the chuck 34 to open. Then, the chuck 34 is closed to grip the sheet stack P and pulls it out to the binding position of the binding device 5. The binding device 5 binds one end of the sheet stack P gripped by the chuck 34. Thereafter, the motor 35 is reversed to push the sheet stack P to the original position. The binding device 5 and moving unit 6 are conventional and will not be described specifically.

Figure 10:
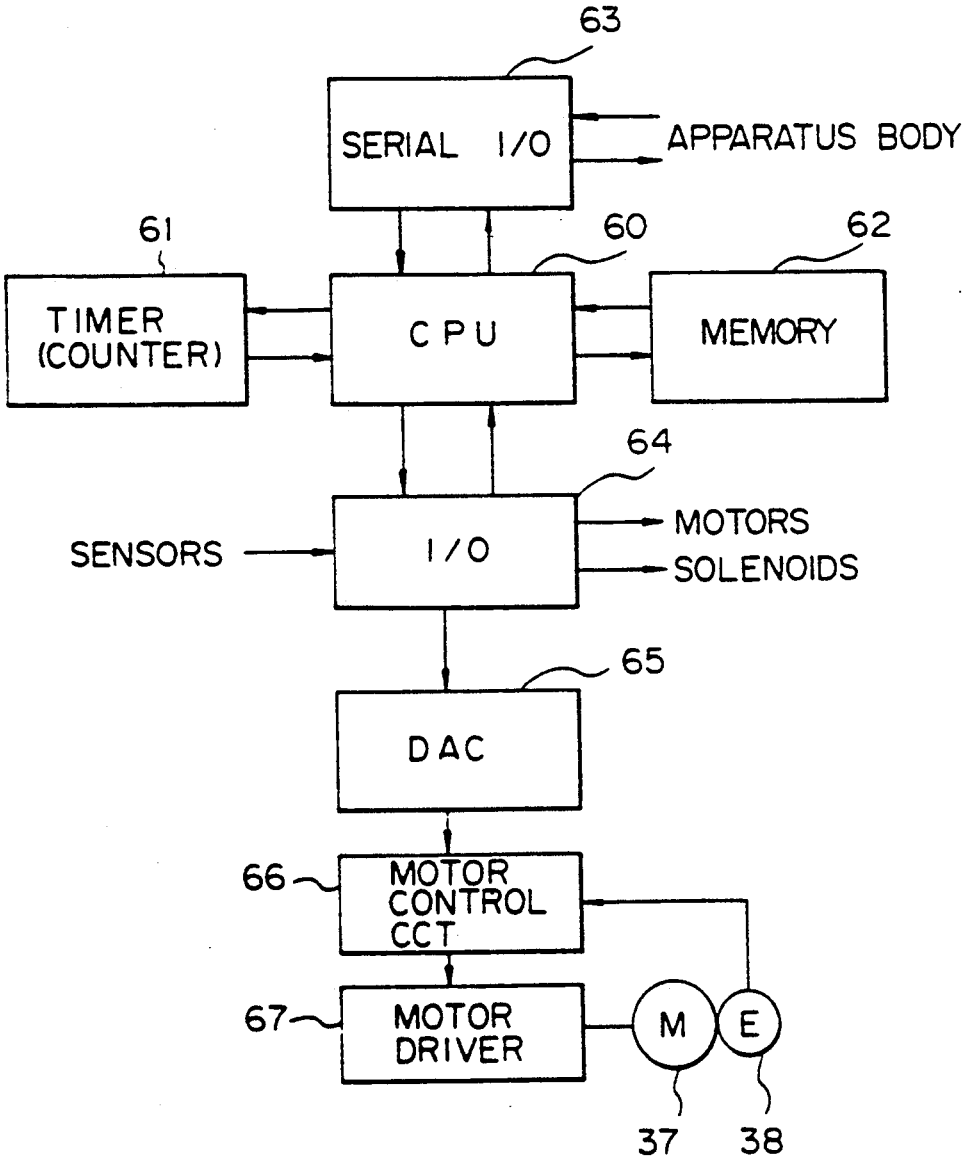
FIG. 10 is a block diagram schematically showing circuitry for controlling a discharge motor included in the embodiment.

Referring to FIG. 10, circuitry for controlling the discharge motor 37 is shown in a schematic block diagram. As shown, the CPU or controller 60 interchanges signals including a motor 37 drive signal with the image forming apparatus via a serial input/output (I/O) interface 63. Also, the CPU 60 interchanges data with a timer or counter 61 and a memory 62 implemented by a ROM (Read Only Memory) storing programs and a RAM (Random Access Memory) usable to store data to be updated. The outputs of the sensors are sent to the CPU 60 via an I/O 64 while control signals for the motors and solenoids are sent from the CPU 60 via the I/O 64. Likewise, a control signal for rotating the discharge motor 37 at a controlled speed is sent from the CPU 60 to a digital-to-analo converter (DAC) 65 via the I/O 64. The DAC converts the input digital data to analog data. The resulting analog signal from the DAC 65 is applied to a motor control circuit 66 which in turn delivers a corresponding drive control signal to a motor driver 67. As a result, the motor driver 67 rotates the discharge motor 37 at a speed matching the drive control signal. An encoder 68 is directly connected to the discharge motor 37 and generates a pulse signal whose frequency is proportional to the rotation speed of the motor 37. The pulse signal from the encoder 68 is fed back to the motor control circuit 66. In response, the motor control circuit 66 compares the frequency of the pulse signal and the value of the analog signal from the DAC 65 and so controls the motor driver 67 as to minimize their difference.

Figure 11A:
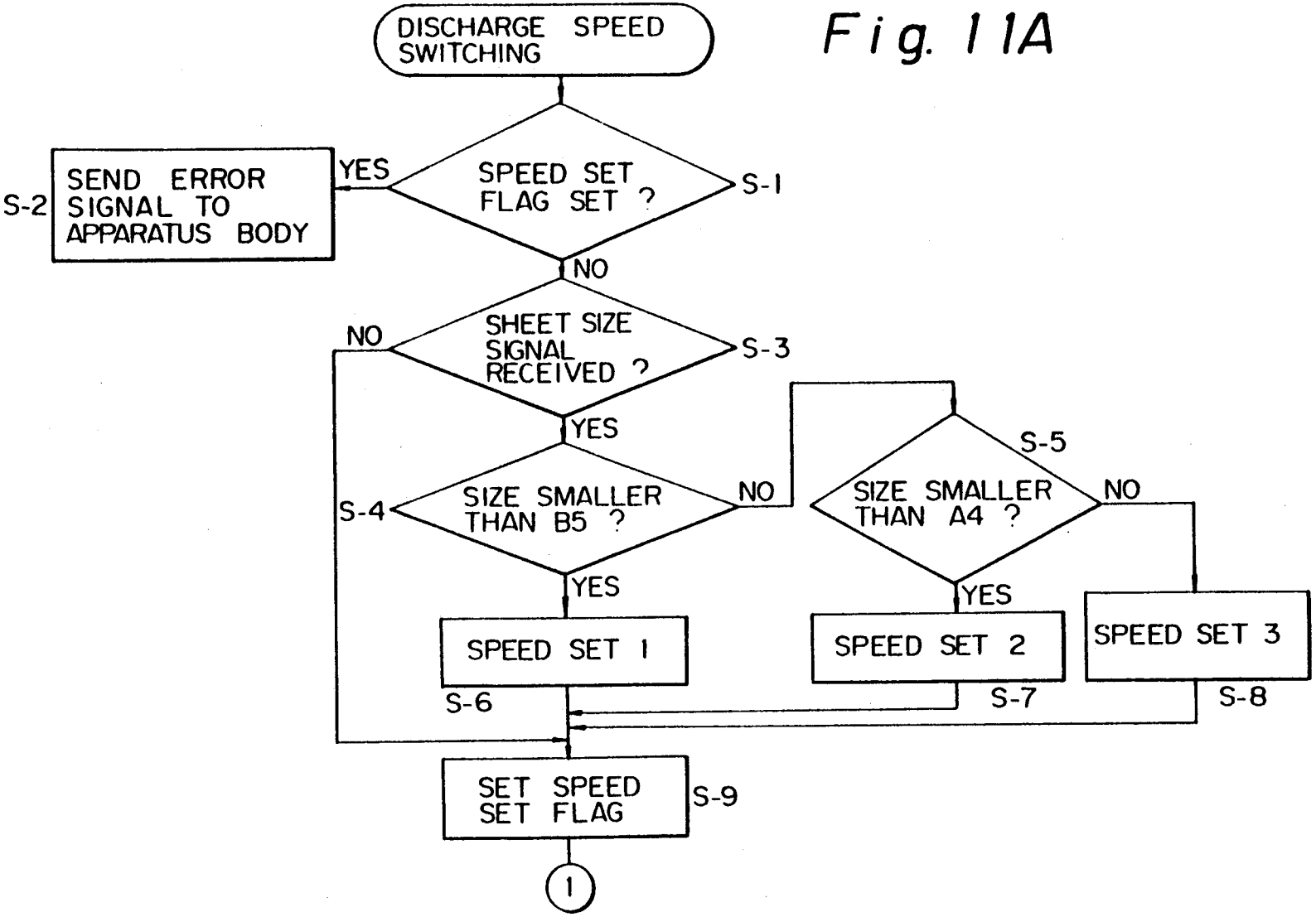
FIGS. 11A and 11B are flowcharts representative of a specific operation of the circuitry of FIG. 10.
Figure 11B:
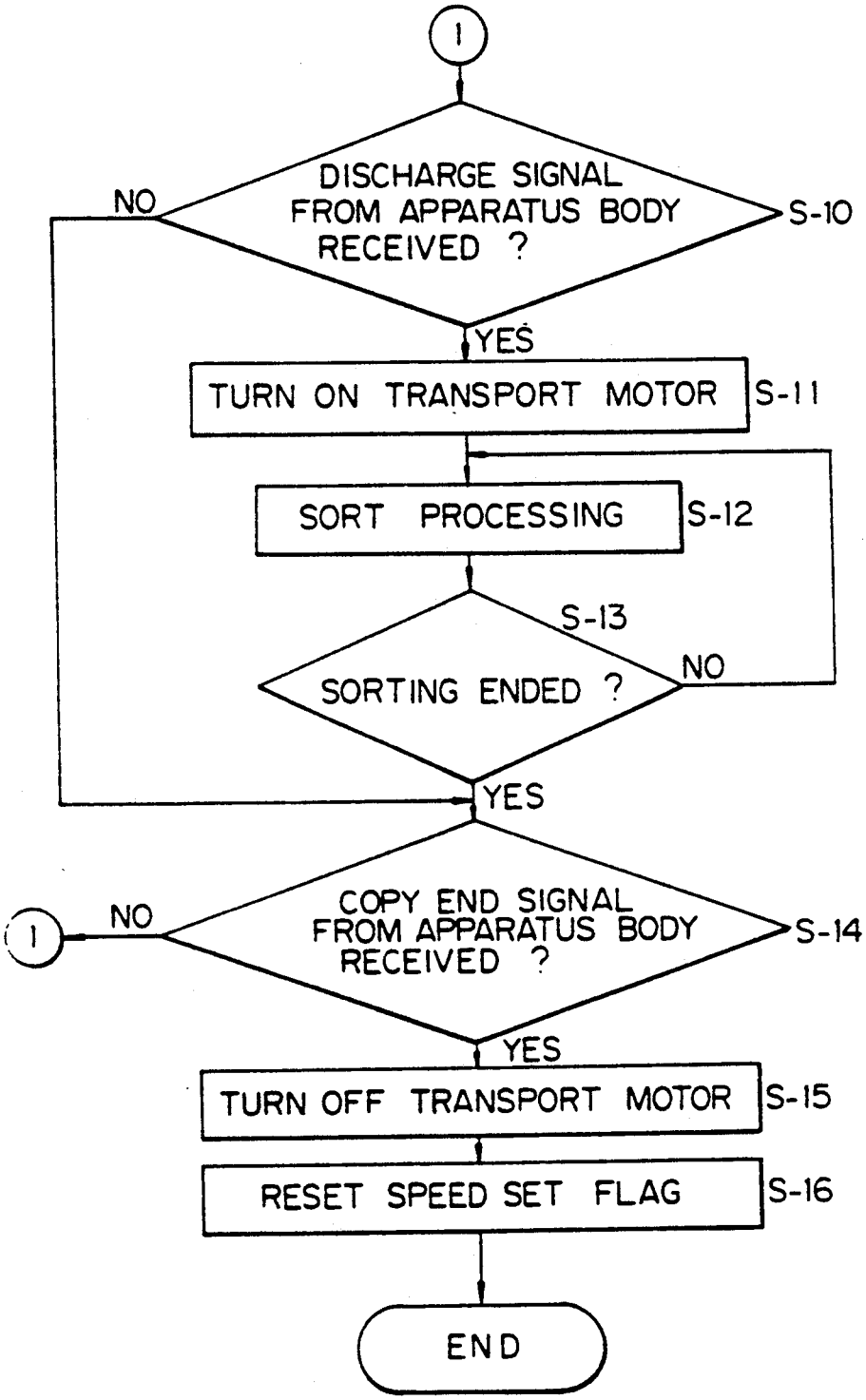
Figure 12:
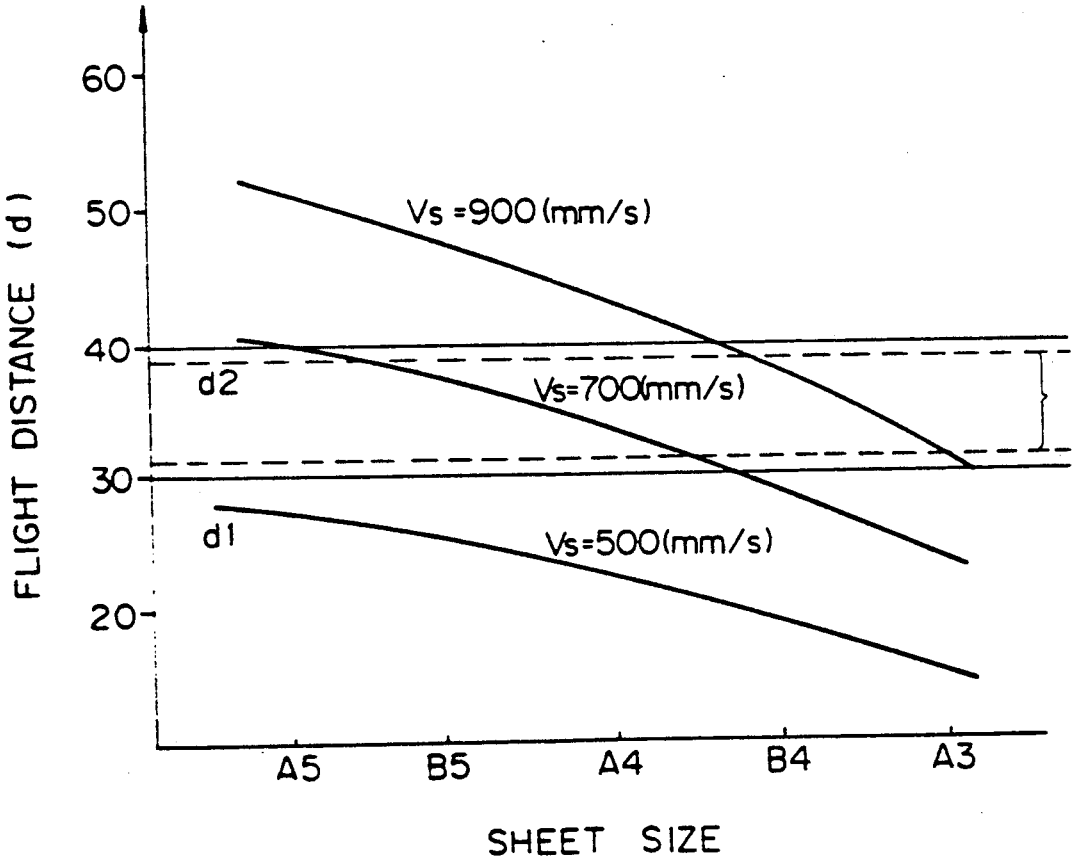
FIG. 12 is a graph indicative of a relation between the sheet size and the distance which a sheet flies to a bin tray.

FIGS. 11A and 11B demonstrate a specific operation of the CPU or controller 60 for changing the rotation speed of the discharge motor 37, i.e., the sheet discharge speed in matching relation to the size of sheets to be transferred from the image forming apparatus to the finisher. FIG. 12 is a graph indicative of a relation between the size of a plain sheet (surface density of 80 $g/m^2$) and the distance d which the sheet flies over the bin tray 1. How to control the sheet discharge speed on the basis of the sheet size will be described with reference to FIGS. 11A, 11B and 12.

As shown in FIG. 12, the distance d which the sheet S is caused to fly by the high-speed transport by the lower discharge roller 36 increases with the increase in the initial speed $V_s$ (mm/sec) at which the sheet S is discharged by the roller 36 and with the decrease in the size of the sheet S. Hence, in the illustrative embodiment, the initial discharge speed $V_s$ which gives adequate flight distances $d_1$ to $d_2$ ranges from about 600 to about 1,000 for the sheet sizes of A5 to A3. Therefore, all that is required is to control the rotation speed $V_s$ of the lower discharge roller 36 within the range of from 600 to 1,000 in matching relation to the sheet size.

As shown in FIG. 11A, the CPU 60 determines whether or not a speed set flag is set (step S-1) first. If the flag is set (Y, S-1), the CPU 60 sends an error signal to the image forming apparatus (S-2); if otherwise, it determines whether or not a sheet size signal from the image forming apparatus has arrived (S-3). If the sheet size signal has arrived (Y, S-3), the CPU 60 determines whether or not the sheet size signal is indicative of a size smaller than B5 (S-4). If the answer of the step S-4 is positive, the CPU 60 sets a small size speed $v_1$ for the discharge motor 37 (S-6, SPEED SET 1) and then sets the speed set flag (S-9). If a sheet size signal has not been received (N, S-3), the CPU 60 immediately executes the step S-9 for setting the speed set flag. If the answer of the step S-4 is negative, the CPU 60 determines whether the sheet size indicated by the sheet size signal is smaller than A4 (S-5). If the answer of this step S-5 is positive, the CPU 60 sets a medium size speed $v_2$ higher than the speed $v_1$ for the discharge motor 37 (S-7, SPEED SET 2) and then executes the step S-9. If the sheet size signal indicates a sheet size not smaller than A4 as determined in the step S-5, the CPU 60 sets a great size speed $v_3$ higher than the speed $v_2$ (S-8, SPEED SET 3) and then advances to the step S-9.

As shown in FIG. 11B, after setting the speed set flag in the step S-9, FIG. 11A, the CPU 60 determines whether or not a sheet discharge signal has been received from the image forming apparatus (S-10). If the answer of the step S-10 is positive, the CPU 60 energizes the solenoid associated with the selector 51 to thereby unblock the path P2 and, at the same time, starts rotating the discharge motor 37 (S-11). Then, the CPU 60 executes sort processing (S-12). Subsequently, the CPU 60 determines whether or not the sorting operation has ended (S-13) and, if the answer is positive, determines whether or not a copy end signal has been received from the image forming apparatus (S-14). If the answer of the step S-13 is negative, meaning that the sorting operation is under way, the CPU 60 repeats the sort processing of step S-12. If a copy end signal has been received as determined in the step S-14, the CPU 60 stops rotating the discharge motor 37 (S-15), deenergizes the solenoid associated with the selector 51, and resets the speed set flag (S-16), thereby completing the switchover of the paper discharge speed. If a copy end signal has not been received as determined in the step S-14), the program returns to the step S-10.

Figure 13A:
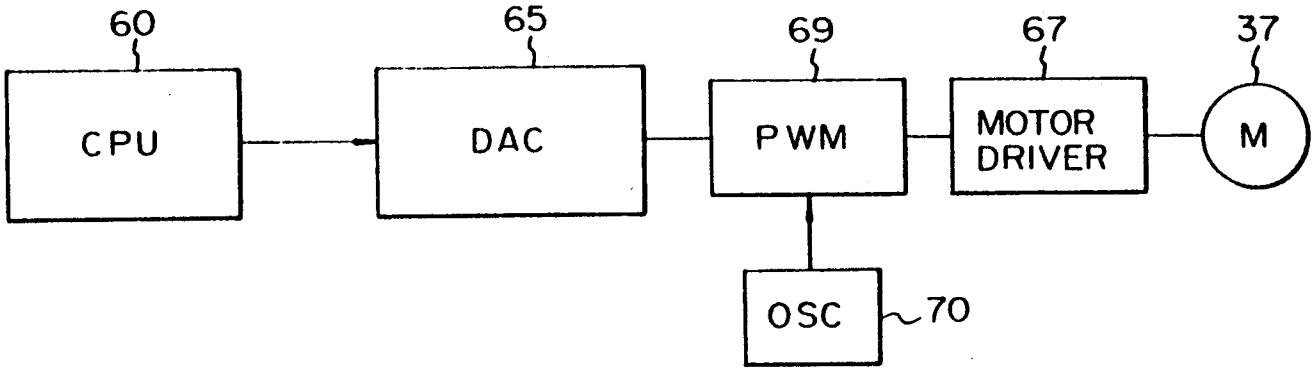
FIG. 13A is a block diagram schematically showing modified discharge motor control circuitry.
Figure 13B:
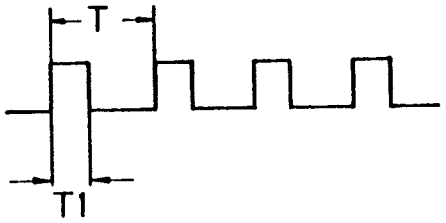
FIG. 13B shows the waveform of the output of a pulse width modulator included in the circuitry of FIG. 3A.

While the circuitry of FIG. 10 for controlling the discharge motor 37 is implemented with a feedback signal corresponding to the rotation speed of the discharge motor 37, it may be replaced with simpler control circuitry if heavy loads are not expected to act on the discharge motor 37. Specifically, as shown in FIG. 13A, modified or simpler control circuitry causes the CPU 60 to deliver a control signal for setting up a particular rotation speed of the discharge motor 37 to the DAC 65. In response, the DAC 65 feeds a corresponding analog signal to a pulse width modulator (PWM) 69. Also, an oscillator 70 delivers a pulse signal having a predetermined frequency and a pulse width of $T_1$ to the PWM 69. Assuming that the period of the pulse signal is T, the PWM 69 modulates the pulse signal such that $T_1/T$ is proportional to the input analog value. As a result, the motor driver 67 generates a drive voltage proportional to the analog value corresponding to the control signal, thereby rotating the discharge motor 37 at a speed proportional to the analog value. FIG. 13B shows the waveform of the pulse signal from the PWM 69. Although the modified control circuitry cannot control the speed of the discharge motor 37 with accuracy since it does not use a servo system, it does not need any expensive integrated circuits for the control and, therefore, cuts down the cost.

Figure 14:
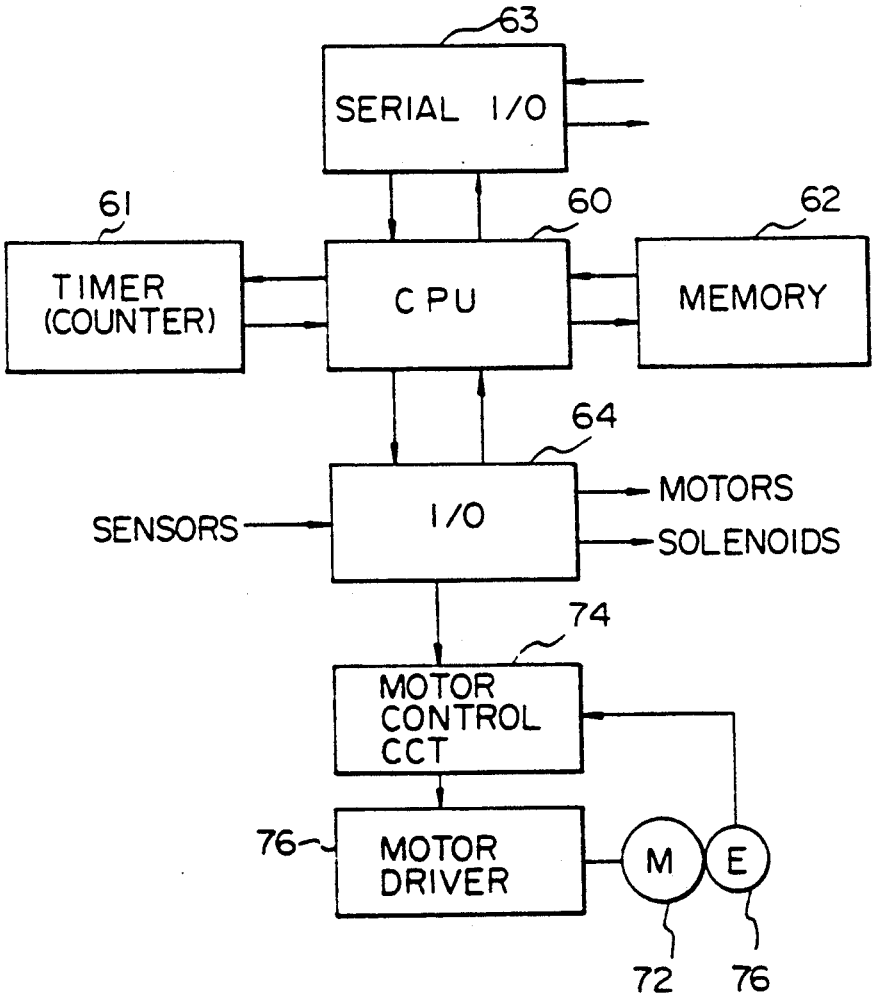
FIG. 14 is a block diagram schematically showing circuitry for controlling a motor included in the embodiment for driving a sheet positioning device.

FIG. 14 shows circuiry for controlling the motor 72 which drives the positioning device 4. As shown, the blocks 60–64 are constructed and arranged in the same manner as in the discharge motor control circuitry shown in FIG. 10. In operation, on receiving size information from the image forming apparatus, the CPU 60 generates a control signal, or digital data, for controlling the motor 72 to a particular rotation speed matching the size information. The digital data is fed to a motor control circuit 74 via the I/O 64. In response, the motor control circuit 74 generates a drive control signal corresponding to the digital data and feeds it to a motor driver 76. As a result, the motor driver 72 drives the motor 72 at a speed matching the drive control signal. An encoder 76 is directly connected to the motor 72 and generates a number of pulses proportional to the rotation speed of the motor 72. The pulses are fed back from the encoder 76 to the motor control circuit 74. The motor control circuit 74 compares the number of pulses fed back thereto and the valve of the received digital data and so controls the motor driver 74 as to stop the rotation of the motor 72 when the number of pulses coincides with the value of the digital data.

In the illustrative embodiment, the regulating position where the jogger wire regulates the position of the sheet S falling onto the bin tray 1 is shown and described as being spaced apart from the reference wall A by a distance slightly smaller than double the width of the sheet S. Alternatively, the regulating position may be closer to the reference wall A if the position where the sheet 6 falls does not noticeably change in the right-and-left direction. Then, the sheet stack P picked up from the bin tray 1 will be arranged by hand more easily. If desired, the jogger wire 33 may be replaced with a jogger band or an upright jogger rod. The device for moving the bin trays 1 up and down is not limited to the one using the wires 30 as shown and described. The rollers 31 are not essential and may be replaced with projections and recesses formed in the upper and lower surfaces of the cam tracks 10. Of course, the balls 31 may be replaced with cylindrical rollers.

In summary, it will be seen that the present invention provides a finisher capable of controlling the flight distance of a sheet to a bin tray to adequate one without regard to the size of the sheet and, therefore, preventing the sheet from dropping from the bin tray, being received incompletely in the bin tray, or being inaccurately positioned on the bin tray. This unprecedented advantage is derived from the fact that speed control means controls the rotation speed of a discharge motor in response to size information.

Since the size information is sent from an image forming apparatus to which the finisher is operatively connected, the finisher does not need sheet size measuring means and is, therefore, miniature and low cost.

The speed control means controls the rotation speed of the discharge motor without regard to the speed at which a sheet introduced into the finisher is transported to the downstream side. Hence, not only the sheet is smoothly received by the finisher, but also the discharge speed of the sheet onto the bin tray is adequately controlled.

Moreover, when the sheet entered the finisher has a size which cannot handled by a positioning device included in the finisher, a control device shifts, before a discharge roller discharges the sheet onto the bin tray, a pressing member from a standby position toward a reference surface by a predetermined distance, e.g., to a regulating position spaced apart from the reference surface by a distance slightly smaller than double the width of the sheet. This prevents the order of sheet paper stacks discharged onto the bin tray from differing from the discharge order of sheets.

Various modifications will become possible for those skilled in the art after receiving the teachings of the present disclosure without departing from the scope thereof.

What is claimed is:

1. A finisher, operatively connectable to a sheet discharging device, for finishing sheets discharged from said sheet discharging device and distributed to a plurality of bin trays which are arranged one above another in said finisher, said finisher comprising:

a discharge roller for sequentially discharging the sheets driven out of the sheet discharging device to the bin trays;

a drive motor for driving said discharge roller; and control means for controlling a rotation speed of said drive motor in response to size information representative of a size of the sheets sequentially discharged to the bin trays.

2. A finisher as claimed in claim 1, wherein the size information representative of a size of the sheets sequentially discharged to the bin trays is sent from the sheet discharging device to said finisher.

3. A finisher as claimed in claim 1, wherein said control means controls the rotation speed of said drive motor without regard to a speed at which the sheets transferred from the sheet discharging device to said finisher are transported to a downstream side of said sheet discharging device.

4. A finisher as claimed in claim 1, wherein said discharge roller is fixed at a discharge location and said plurality of bin trays are movable with respect to said discharge roller.

5. A finisher as claimed in claim 1, wherein said finisher further comprises means for moving said plurality of bin trays in the horizontal and vertical directions.

6. A finisher as claimed in claim 5, wherein said means for moving said plurality of bin trays in the horizontal and vertical directions comprises cam tracks including horizontal cam sections for moving the bin trays a predetermined distance in the horizontal direction.

7. A finisher as claimed in claim 1, wherein said controlling means comprises a central processing unit connected to a memory, a timer, a serial input/output interface for interfacing with the sheet discharging device, and an input/output interface for receiving sensor inputs.

8. A finisher as claimed in claim 7, wherein said central processing unit comprises means for setting a speed set flag in response to a received sheet size signal, means for turning on a transport motor and sorting in response to a sheet discharge signal received from said sheet discharging device, and means for turning off said transport motor and resetting said speed set flag in response to a copy end signal received from said sheet discharging device.

9. A finisher operatively connectable to a sheet discharging device for finishing sheets driven out of said sheet discharging device, comprising:

a plurality of bin trays, each having a stacking surface which is inclined in an intended direction of sheet transport for receiving sheets driven out of the sheet discharging device;

a discharge roller for sequentially discharging the sheets to said plurality of bin trays;

positioning means comprising a pressing member for positioning the sheets stacked on said plurality of bin trays by pressing said sheets toward a reference surface; and control means for controlling a positioning operation of said positioning means on the basis of a size of the sheets such that when the sheet to be received in said bins is of a size which cannot be pressed so that it abuts against said reference surface, said pressing member is moved, before said discharge roller discharges said sheet, from a standby position to a regulating position which is adjacent to and spaced apart from the reference surface by a predetermined distance and then stopped at said regulating position.

10. A finisher as claimed in claim 9, wherein the predetermined distance is slightly smaller than twice a width of the sheet with respect to the intended direction of sheet transport for receiving sheets driven out of the sheet discharging device.

11. A finisher as claimed in claim 9, wherein said finisher further comprises means for binding or punching the sheets stacked on said plurality of bin trays.

12. A finisher as claimed in claim 9, wherein said controlling means comprises means for controlling the distance by which the pressing member moves from said standby position in response to size information sent from a sensor located on a transport path or sent from a sensor located on a transport path or sent from the image forming apparatus.

13. A finisher as claimed in claim 9, wherein said pressing member is provided on each of the bin trays so as to slide on the stacking surface of the bin tray.

14. A finisher as claimed in claim 9, wherein said pressing member comprises a single elongate member extending through all the bin trays for positioning sheets on all the bin trays at the same time.

* * * * *